US007815305B2

(12) United States Patent
Bergman et al.

(10) Patent No.: US 7,815,305 B2
(45) Date of Patent: Oct. 19, 2010

(54) ELECTRONIC PAINT BRUSH WITH SCANNER AND DISPENSERS

(75) Inventors: Anthonie H Bergman, Eindhoven (NL); Hubertus M. R. Cortenraad, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 1130 days.

(21) Appl. No.: 10/597,157

(22) PCT Filed: Jan. 12, 2005

(86) PCT No.: PCT/IB2005/050140

§ 371 (c)(1),
(2), (4) Date: Jul. 13, 2006

(87) PCT Pub. No.: WO2005/070684

PCT Pub. Date: Aug. 4, 2005

(65) Prior Publication Data

US 2009/0141112 A1 Jun. 4, 2009

Related U.S. Application Data

(60) Provisional application No. 60/536,562, filed on Jan. 15, 2004.

(51) Int. Cl.
*B41J 3/36* (2006.01)
*B41J 29/38* (2006.01)

(52) U.S. Cl. ..... 347/109; 347/14

(58) Field of Classification Search ..... 347/109, 347/105, 14; 346/143; 400/88
See application file for complete search history.

(56) References Cited

U.S. PATENT DOCUMENTS

| | | | | | |
|---|---|---|---|---|---|
| 4,899,228 | A * | 2/1990 | Sano et al. | 358/473 |
| 4,933,867 | A * | 6/1990 | Ishigaki | 358/1.5 |
| 4,949,283 | A * | 8/1990 | Yamauchi et al. | 358/1.14 |
| 5,063,451 | A * | 11/1991 | Yanagisawa et al. | 346/143 |
| 5,446,559 | A * | 8/1995 | Birk | 358/473 |
| 5,825,995 | A * | 10/1998 | Wiklof et al. | 358/1.18 |
| 5,927,872 | A * | 7/1999 | Yamada | 400/88 |
| 5,986,769 | A * | 11/1999 | Krzyminski | 356/445 |
| 6,002,124 | A * | 12/1999 | Bohn et al. | 250/208.1 |
| 6,116,707 | A * | 9/2000 | Avida | 346/139 R |
| 6,338,555 | B1 | 1/2002 | Hirose | |
| 6,357,939 | B1 | 3/2002 | Baron | |
| 6,467,978 | B1 * | 10/2002 | Tideman, Jr. | 400/76 |

(Continued)

FOREIGN PATENT DOCUMENTS

JP 58098269 A * 6/1983

(Continued)

*Primary Examiner*—Stephen D Meier
*Assistant Examiner*—Leonard S Liang

(57) ABSTRACT

An electronic brush (10) for dispensing ink (22) onto a writable medium (30) employs an electronic-brush housing (12), at least one ink dispenser (20) coupled to the electronic-brush housing, an electronic-brush scanner (14) coupled to the electronic-brush housing, and a controller (16). The controller is in electrical communication with the ink dispenser and the electronic-brush scanner. A position of the electronic brush is determined based on at least one position indicator in a first portion of a dispensed image that is scanned by the electronic-brush scanner and communicated to the controller. An ink-dispense signal is sent from the controller to the ink dispenser based on the determined electronic-brush position.

22 Claims, 4 Drawing Sheets

U.S. PATENT DOCUMENTS

| | | | | |
|---|---|---|---|---|
| 6,517,266 | B2 | 2/2003 | Saund | |
| 6,648,528 | B2 * | 11/2003 | Hardisty et al. | 400/323 |
| 6,846,119 | B2 * | 1/2005 | Walling | 400/88 |
| 6,942,335 | B2 * | 9/2005 | Trent | 347/109 |
| 6,962,450 | B2 * | 11/2005 | Brouhon et al. | 400/76 |
| 2002/0154186 | A1 * | 10/2002 | Matsumoto | 347/14 |
| 2005/0018033 | A1 * | 1/2005 | Walling | 347/109 |
| 2005/0135857 | A1 * | 6/2005 | Saund et al. | 400/88 |

FOREIGN PATENT DOCUMENTS

| | | | | |
|---|---|---|---|---|
| JP | 59145166 | A | * | 8/1984 |
| JP | 63053068 | A | * | 3/1988 |
| JP | 63053084 | A | * | 3/1988 |
| WO | WO9105665 | A1 | | 5/1991 |
| WO | WO0186938 | A3 | | 11/2001 |
| WO | WO03006244 | A1 | | 1/2003 |
| WO | WO03006249 | A1 | | 1/2003 |

* cited by examiner

ELECTRONIC PAINT BRUSH WITH SCANNER AND DISPENSERS

This invention relates generally to hand-held printers, and more specifically to a method and a system for dispensing an image onto a writable medium with a handheld electronic brush.

Handheld printers have been designed to print an image onto an image-receiving medium such as paper. While a majority of commercially available printers print on paper that is fed through a printer system, a few handheld printers are being developed to print directly onto a printable surface by the movement of the printer over the medium.

An early example of an inkjet handheld printer that was designed to print lines of characters on a paper is described in "Improvements Relating to Hand-Held Printers," Ross et al., International Patent Application No. WO9105665, published May 2, 1991. This handheld printer was proposed for quick printing of small amounts of information on documents for applications such as printing of receipts or printing "sell-by" dates.

Researchers have been focusing on handheld printers that discharge ink accurately without requiring constant pressure of the printer on the writing medium. One such method and associated device is described in "Hand-Held Printer," Hirose, U.S. Pat. No. 6,338,555 issued Jan. 15, 2002. The handheld printer receives print data corresponding to one print line, and discharges ink from ink nozzles while moving the inkjet head in the orthogonal direction to the aligned direction of the nozzles.

Handheld printers may receive digital data from computers either by wire or wirelessly, the latter frequently using Bluetooth or other radio frequency technology. An exemplary wireless handheld printer that can be used to print bar codes or date stamps is described in "A Printer," Woodman et al., International Patent Application No. WO0186938 published Nov. 15, 2001.

While most suggested applications for handheld printers include printing on paper surfaces having the width of the printer or smaller, researchers are working on applying printing technology to printing on larger surfaces such posters, wallpaper, or a wall screen. One exemplary printer that can print onto a whiteboard is described in "Systems and Methods for Hand-Held Printing on a Surface or Medium," Saund, U.S. Pat. No. 6,517,266 issued Feb. 11, 2003. The printer includes at least one printhead, a global position system (GPS) that senses a position of the printhead, and a control mechanism that actuates the printhead based on the sensed position.

Another handheld printer that is used for printing on larger surfaces is taught in "A Sensor and Ink-Jet Print-Head," Walling, International Patent Application No. WO03006244 published Jan. 23, 2003. This inkjet printer employs one or more sensors along with a coordinate system and angles on a print medium to help position the printer.

The challenge of transferring a large picture or image correctly with a handheld printer to a printable surface is that the printing requires multiple passes or strokes of the printer over the surface, and each stroke needs to be aligned with the previous stroke. Printing a large image requires a process whereby the position of the handheld printer can be determined accurately and multiple strokes over the surface do not cause waviness, gaps, and alignment artifacts of the device.

In light of the discussion above, there continues to be a need for an effective handheld printer system and method that can print with multiple passes over variably sized large surfaces while avoiding problems associated with aligning each new pass. Additionally, the printer needs to be able to control the deposit of ink, to receive and store the image that is being conveyed to the display, and to determine the location of the printer in relation to the surface being printed.

One form of the present invention is an electronic brush for dispensing ink onto a writable medium. The electronic brush includes an electronic-brush housing. At least one ink dispenser and an electronic-brush scanner are coupled to the electronic-brush housing. A controller is in electrical communication with the ink dispenser and the electronic-brush scanner. A position of the electronic brush is determined based on at least one position indicator in a first portion of a dispensed image that is scanned by the electronic-brush scanner and communicated to the controller. An ink-dispense signal is sent from the controller to the ink dispenser based on the determined electronic-brush position.

Another form of the present invention is a method of dispensing ink on a writable medium. A first position indicator in a first portion of a dispensed image on the writable medium is scanned. A position of an electronic brush is determined based on the scanned position indicator. Image data is modified to embed a second position indicator in a second portion of the image based on the determined position of the electronic brush. The second portion of the image including the second position indicator is dispensed onto the writable medium.

Another form of the present invention is a system for dispensing ink on a writable medium. The system includes means for scanning a first position indicator in a first portion of a dispensed image on the writable medium, means for determining a position of an electronic brush based on the scanned position indicator, means for modifying image data to embed a second position indicator in a second portion of the image based on the determined position of the electronic brush, and means for dispensing the second portion of the image including the second position indicator onto the writable medium.

The aforementioned forms as well as other forms and features and advantages of the present invention will become further apparent from the following detailed description of the presently preferred embodiments, read in conjunction with the accompanying drawings. The detailed description and drawings are merely illustrative of the present invention rather than limiting, the scope of the invention being defined by the appended claims and equivalents thereof.

Various embodiment of the present invention are illustrated by the accompanying figures, wherein.

Figure 1:
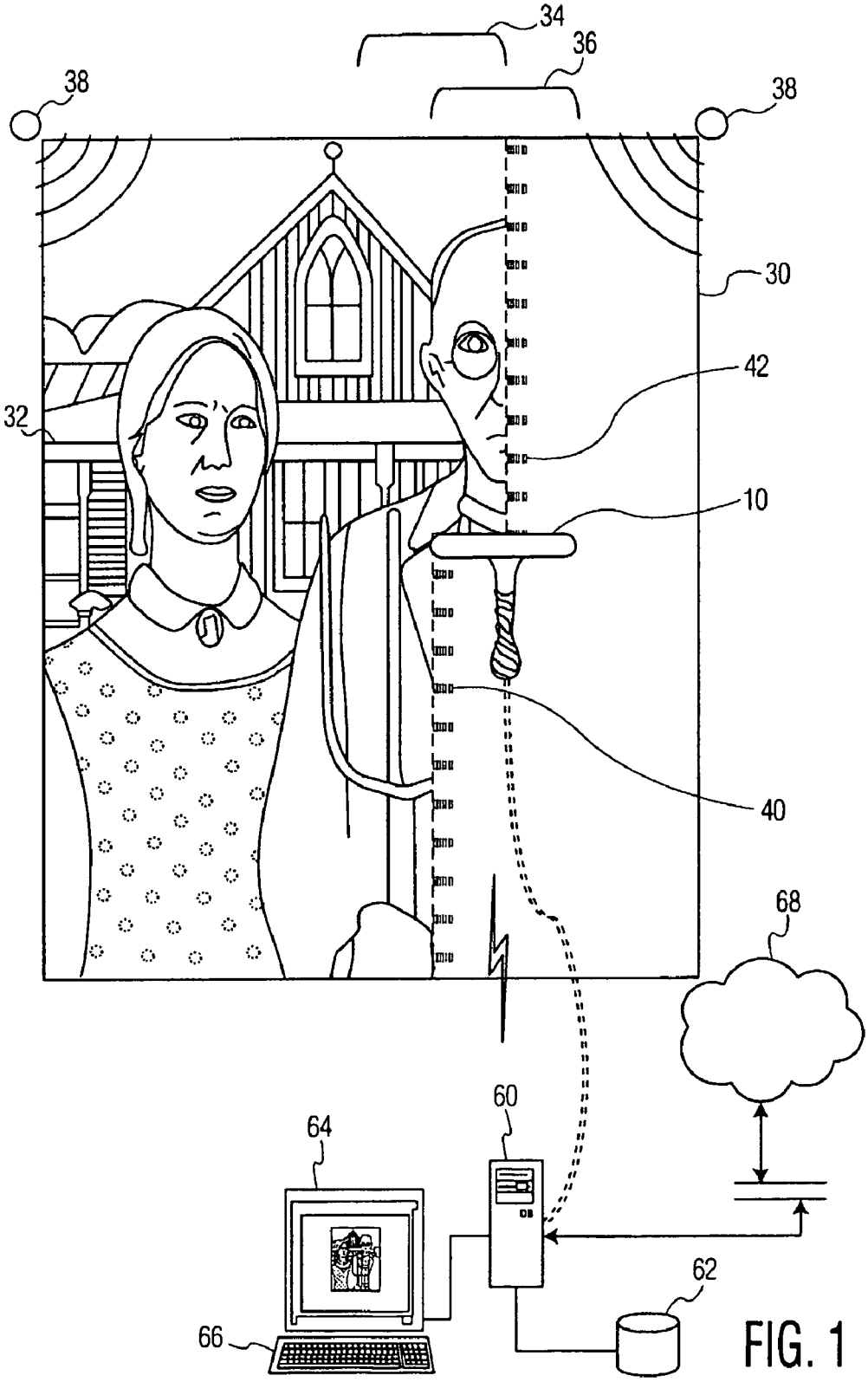
FIG. 1 is an illustration of a system for dispensing ink including an electronic brush in accordance with one embodiment of the current invention.
Figure 2:
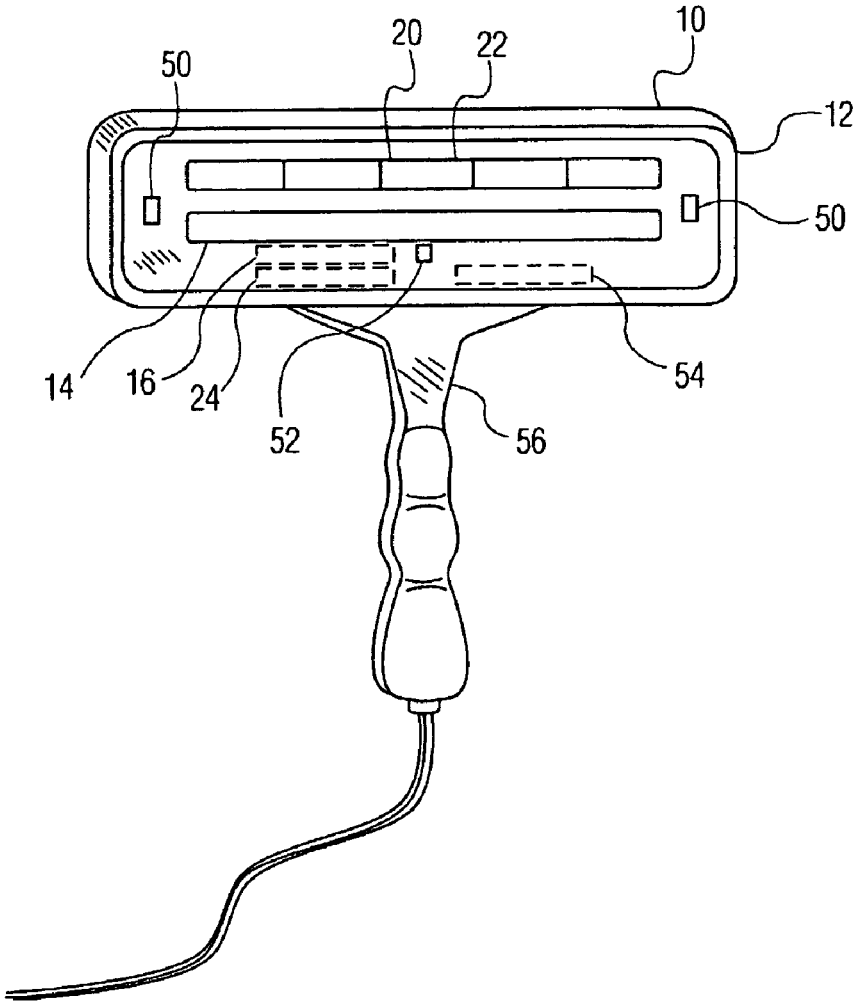
FIG. 2 is an illustration of an electronic brush in accordance with one embodiment of the current invention.

FIG. 1 illustrates a system for dispensing ink onto a writable medium including an electronic brush 10 as illustrated in FIG. 2. Referring to FIGS. 1 and 2, the system includes an electronic brush 10 with an electronic-brush housing 12. One or more ink dispensers 20 and an electronic-brush scanner 14 are coupled to electronic-brush housing 12. A controller 16 is in electrical communication with ink dispensers 20 and electronic-brush scanner 14 to dispense ink 22 and write an image 32 onto a writable medium 30. When the height or width of a writable medium is larger than the width of one stroke of electronic brush 10, electronic brush 10 may write an image 32 onto writable medium 30 by dispensing ink with multiple strokes of electronic brush 10, each subsequent stroke aligned with the previous stroke so that image 32 can be written without gaps, waviness, or image shifts.

An exemplary electronic brush 10, which has a relatively flat, elongated surface area in the shape of a strip or bar, passes over portions of writable medium 30 to dispense ink 22. As electronic brush 10 is moved or swept across writable medium 30, an image is transferred or written onto writable medium 30. Image 32 includes, for example, a picture, a photograph, text, a drawing, an illustration, a graphic, a T-shirt design, or other image type that can be written onto writable medium 30. As electronic brush 10 is stroked across writable medium 30, image 32 is written by selectively dispensing ink 22 onto writable medium 30.

Knowledge of the electronic-brush position including the location and rotation of electronic brush 10 is needed to accurately write image information onto writable medium 30, particularly for stitching together image information of consecutive strokes of electronic brush 10. When electronic brush 10 is placed against the surface of writable medium 30, the position of electronic brush 10 is determined by scanning at least one position indicator 40 in a first pass or a first portion 34 of image 32 written onto writable medium 30. Position indicators 40 comprising, for example, a plurality of adapted pixels within dispensed image 32, provide electronic brush 10 with the capability to determine the location and rotation of electronic brush 10 so that additional image data can be written onto writable medium 30. To determine the position of electronic brush 10, a first position indicator 40 is scanned with an electronic-brush scanner 14. Image data for image 32 is modified to insert additional position indicators 40 in a second portion 36 of image 32, which is written as electronic brush 10 is stroked across the surface of writable medium 30.

First portion 34 of dispensed image 32 is scanned by electronic-brush scanner 14 and communicated to controller 16. A position of electronic brush 10 is determined based on one or more position indicators 40 in first portion 34 of the dispensed image 32. An ink-dispense signal is sent from controller 16 to ink dispensers 20 based on the determined electronic-brush position, and ink 22 is dispensed accordingly.

Each position indicator 40 may contain a predefined code such as an x, y set of coordinates corresponding to the location on writable medium 30 where position indicator 40 will be written or is currently located. In one example, position indicators 40 comprise one or more regions clear of features or one or more areas with dark features. Alternately, position indicators 40 include modified features within image 32 such as lighter areas than the original image data or darker areas than the original image data. Image data can be adjusted, for example, in gray scale for black-and-white image writing, and in one, two, three, or all colors when dispensing colored ink onto writable medium 30. In another example, writable medium 30 has position indicators pre-written onto the surface of writable medium 30 with, for example, fine or faint marks such that the position information can be read yet have minimal impact on the quality of the written image.

The position indicators 40 may be coded using one of many suitable coding schemes. In one example that uses a pixel-based coordinate system, the position indicator 40 is coded with an x and a y coordinate corresponding to the distance from the upper left corner of writable medium 30. In another example, position indicator 40 is coded with x and y coordinates corresponding to the number of writable elements from the lower left corner of writable medium 30. In another example, position indicators 40 are assigned codes that have error-detection capability, or are self-correcting, with the location information for each coded position indicator being generated and stored in a look-up table, or decoded using a suitable decoding algorithm. In yet another example, a cross hair with a position code for a relative or an absolute reference is coded onto writable medium 30. Other codes can be applied to position indicators 40, such as redundant codes, randomized codes, Gray codes, error-correcting codes, codes with a checksum, or codes that directly represent the x and y position such as a decimal or binary-encoded number. It should be observed that some algorithms for detecting position indicators 40 require knowledge of the original, unmodified image data being deciphered, whereas other algorithms do not require access to the original image data to determine electronic-brush location and rotation.

As a portion of dispensed image 32 is scanned, one or more position indicators 40 in first portion 34 of image 32 may be detected to ascertain the position of electronic brush 10 so that additional strokes with electronic brush 10 can be made and additional portions of image 32 can be correctly registered and written onto writable medium 30. For example, the position of electronic brush 10 may be determined by scanning the dispensed image and comparing the scanned image to unmodified image data. Features in the dispensed image are recognized and additional portions of the image are written based on the determination. In this case, features within the image serve as position indicators. In other cases, the position indicators are delineated with dispensed ink 22 or the omission of ink 22 in position indicator features. In another example, position indicators 40 in the dispensed image 32 are scanned to determine a writeable-medium coordinate such as an x or y coordinate, and using the coordinate values to determine the position of electronic brush 10. In another example, a plurality of position indicators 40 in the dispensed image 32 are scanned and the location and rotation of electronic brush 10 is determined based on the scanned position indicators 40.

Ink 22 dispensed from ink dispenser 20 may include dry ink or wet ink such as from an inkjet cartridge, a solid-ink printhead, a dry-ink printhead, a dot matrix printhead, an actuatable felt-tip pen, a non-contact ink dispenser, an ink ejection nozzle, a glue dispenser, or a liquid dispenser.

The writable medium 30 may comprise, for example, a whiteboard, a wall, a poster, a billboard, a fabric, a T-shirt, a notebook, a sheet of paper, a piece of cardboard, a non-paper material, or any other suitable writing surface. Often, writable medium 30 is larger and sometimes appreciably larger than electronic brush 10, requiring additional, overlapping strokes to write an image. Electronic-brush scanner 14 allows the unwritten image data to be recognized and registered to previously written image data. Electronic-brush scanner 14, such as one or more optical scanners or imaging arrays, scans a port ion of dispensed image 32 to detect position indicators and recognizable features so that additional portions of image 32 may be accurately written with electronic brush 10.

Controller 16 may reside within or external to electronic brush 10. Wired connections or wireless connections such as with WiFi or Blue Tooth™ protocols may be made between controller 16 and electronic brush 10 with ink dispensers 20 and electronic-brush scanner 14.

When small rotations of electronic brush 10 occur during brush sweeps across writable medium 30, the result would be excessive waviness and aberrations of the intended image being transferred if no compensation were given for rotation. Compensation of electronic-brush rotations may be established by, for example, reading two or more position indicators 40 spaced apart on writable medium 30 and determining electronic-brush rotation with respect to those position indicators 40. A determination of electronic-brush rotation can be made as electronic brush 10 is passed over writable medium 30, and used to compensate for electronic-brush rotations while the intended image is being written. Alternatively, signals from a tilt sensor 52 or other position detectors 50 attached to electronic brush 10 may be used to determine electronic-brush rotation. These signals are of particular use during the first stroke of electronic brush 10 across writable medium 30.

One or more position detectors 50 may be coupled to electronic brush 10 to determine initial and subsequent positions of electronic brush 10. Position detectors 50 are in electrical communication with controller 16 to provide an electronic-brush position signal to controller 16 based on a movement of electronic brush 10. Position detectors 50 can provide controller 16 with information on the location, rotation, and in some cases, the travel speed of electronic brush 10, which are used to synchronize the strokes of electronic brush 10 and the writing of image 32. Position detectors 50 also provide feedback on the position of electronic brush 10 so that the image 32 can be correctly written, independent of how fast electronic brush 10 is being stroked over writable medium 30.

When electronic brush 10 is initially placed on writable medium 30, position detectors 50 provide information regarding the location and rotation of electronic brush 10. For example, a position detector 50 is attached at one end of electronic brush 10 and a second position detector 50 is attached at an opposite end of electronic brush 10 to allow determination of the location and rotation of electronic brush 10. Position detector 50 may comprise, for example, a wheel position detector coupled to a wheel of electronic brush 10, a trackball, an optical mouse, an ultrasonic transducer, one or more ultrasonic transducers 38 attached to the writable medium, a tilt sensor, or a global positioning system unit. Ultrasonic transducers attached to either electronic brush 10 or writable medium 30 send and receive ultrasonic signals, and then time-of-flight measurements are combined, for example, with telemetry calculations to determine the position and rotation of electronic brush 10.

Image data for image 32 may reside in a memory 24 within electronic brush 10, or in a digital computing device 60 such as a personal computer, a laptop computer, a personal digital assistant (PDA), a database 62 coupled to digital computing device 60, or a server connected to digital computing device 60 via the Internet or other communication network 68. An image-writing application to transfer image data onto writable medium 30 may be run within electronic brush 10 or within digital computing device 60. For example, image-writing application is used to display image 32 on a computer display 64 connected to digital computing device 60 prior to writing the image information onto writable medium 30. Functions and features for writing image 32 onto writable medium 30 may be selected by using an input device 66 such as a keyboard, keypad or a mouse. Selection and manipulations of the intended image prior to writing onto writable medium 30 may be made, for example, with the help of computer software and hardware such as display 64 and input device 66. Controller 16 or digital computing device 60 may have an Internet or web connection to generate, select or receive image information.

Prior to writing, image data may be modified to embed position indicators 40 within the image data or in portions of the writable medium yet-to-be written portions of the writable medium. When the image is dispensed, additional position indicators 42 may be written into the dispensed image or onto writable medium 30 overlapped by a stroke of electronic brush 10. As the image on subsequent strokes is dispensed, previous position indicators 40 may be overwritten or filled in.

Referring again to FIG. 2, electronic brush 10 includes an electronic-brush housing 12, at least one ink dispenser 20 coupled to electronic-brush housing 12, an electronic-brush scanner 14 coupled to electronic-brush housing 12, and a controller 16. Electronic-brush housing 12, shown with a profile similar to a paint roller, may be shaped as a mouse, a pad, a wand, a brush, or other suitable form. Electronic-brush scanner 14 may comprise a linear or two-dimensional optical scanner, an array of one-dimensional solid-state scan bars, one or more imaging arrays such as a CMOS light detector array or a digital camera, or other types of scanning mechanisms. The field of view for electronic-brush scanner 14 is sufficiently large to detect at least one position indicator, and may be large enough to scan two, three, or more position indicators from which accurate location and rotation information can be derived. Two or more spaced-apart electronic-brush scanners 14 may be coupled to electronic-brush housing 12 to increase accuracy in determining the location and rotation of electronic brush 10. Color filters (not shown) may be placed in front of electronic-brush scanner 14 to extract position-indicator information from individual colors comprising the image pixels.

Controller 16 is electrically connected to and in electrical communication with ink dispensers 20 and electronic-brush scanner 14 such as an optical scanner or at least one imaging array. Controller 16 may be a central processing unit (CPU), a dedicated controller, or other suitable electronic circuit such as a field-programmable gate array (FPGA) with an embedded processor. Controller 16 is wired or wirelessly connected to ink dispensers 20 and electronic-brush scanner 14. The position of electronic brush 10 is determined based on at least one position indicator in a first portion of a dispensed image that is scanned by electronic-brush scanner 14 and communicated to controller 16. An ink-dispense signal is sent from controller 16 to ink dispenser 20 based on the determined electronic-brush position. A memory 24 coupled to controller 16 may be included within or external to electronic brush 10.

Electronic brush 10 may include at least one position detector 50 coupled to electronic brush 10 for determining an initial position of electronic brush 10. Position detectors 50 include for example, one or more wheel position detectors connected to wheels of electronic brush 10; one or more trackballs coupled to electronic brush 10; one or more optical position detectors such as an optical mouse located on electronic brush 10; one or more ultrasonic transducers attached to electronic brush 10 or attached to writable medium 30 at locations near one or more sides of writable medium 30; a tilt sensor 52 such as an inclinometer for determining a vertical orientation of electronic brush 10; or a global positioning system unit 54. When used, global position system unit 54 and other types of position detectors determine the location of electronic brush 10 during initial positioning of electronic brush 10 against the writable medium, during strokes of electronic brush 10, or upon removal and return of electronic brush 10 from the surface of the writable medium.

Ink dispenser 20 comprises, for example, an inkjet cartridge, a solid-ink printhead, a dry-ink printhead, a dot matrix printhead, an actuatable felt-tip pen, a non-contact ink dispenser, an ink ejection nozzle, a glue dispenser, or a liquid dispenser. An array of ink dispensers 20 may be configured within electronic-brush housing 12 to provide a wide printable area for each stroke of electronic brush 10. Electronic brush 10 may include a gripping handle 56 for ease in handling and manipulation. Electronic brush 10 may have various interfaces, features and accoutrements that affect the quality, affordability, and adaptability of the device. Fully featured and equipped electronic brush 10, for example, may have a larger memory or may be wirelessly connectable to a personal computer or to the Internet.

Figure 3:
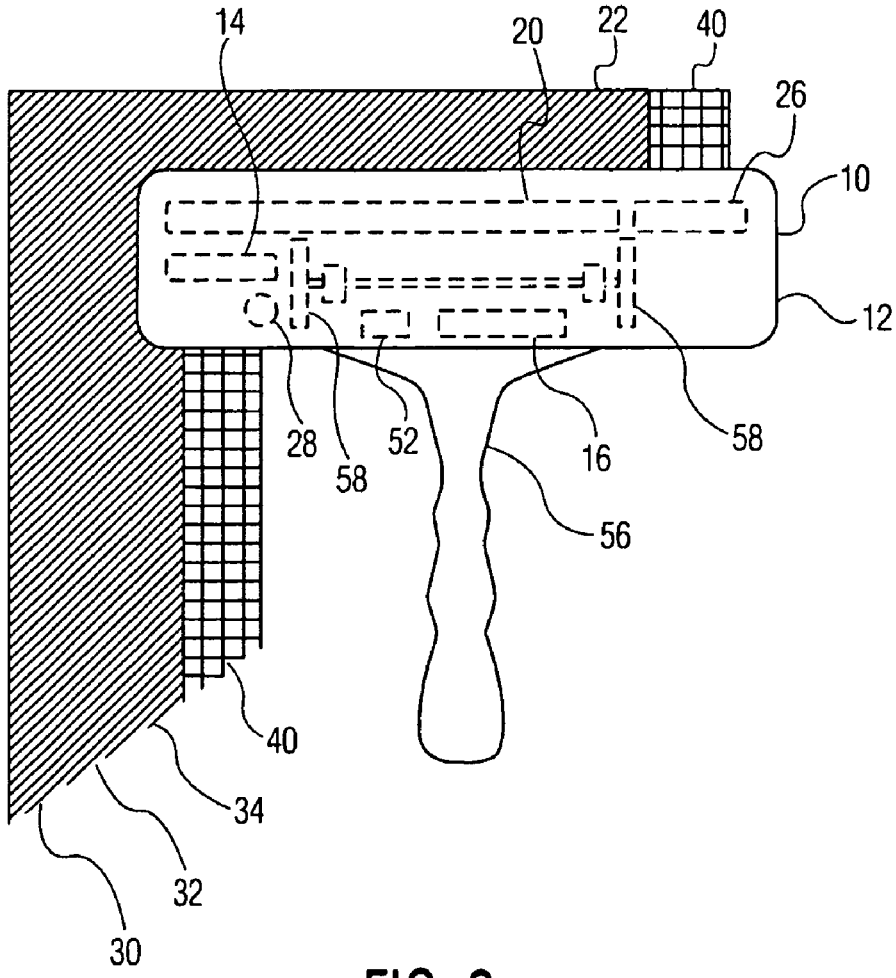
FIG. 3 is an illustration of an electronic brush, in accordance with another embodiment of the current invention.

FIG. 3 illustrates an electronic brush, in accordance with another embodiment of the present invention. Electronic brush 10 includes an electronic-brush housing 12, at least one ink dispenser 20 coupled to electronic-brush housing 12, an electronic-brush scanner 14 coupled to electronic-brush housing 12, and a controller 16. A second ink dispenser 26, which is spaced apart from or continuously formed with ink dispenser 20, prints position indicators 40 onto a writable medium 30. Controller 16 is electrically connected to and in electrical communication with ink dispensers 20 and 26. Controller 16 is electrically connected to electronic-brush scanner 14 to determine the position of electronic brush 10. The position of electronic brush 10 may be determined based on one or more position indicators 40 in a written first portion 34 of a dispensed image 32 that is scanned by electronic-brush scanner 14 and communicated to controller 16. An ink-dispense signal is sent from controller 16 to ink dispenser 20 based on the determined electronic-brush position, and an image 32 is printed onto writable medium 30 with ink 22. An optional tilt sensor 52 is coupled to electronic brush 10. Electronic brush 10 may include a gripping handle 56 for ease in handling and manipulation. Wheels 58 coupled to electronic-brush housing 12 are used to guide electronic brush 12. An image sensor 28 may be coupled to electronic-brush housing 12 to help wheels 58 avoid recently dispensed ink 22.

Figure 4:
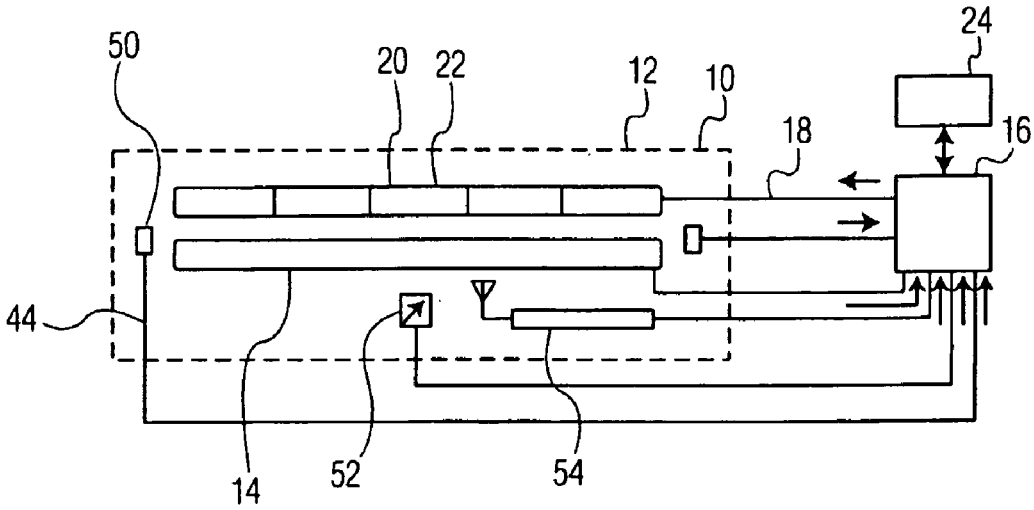
FIG. 4 is a block diagram of a system for dispensing ink on a writable medium in accordance with one embodiment of the current invention.

FIG. 4 is a block diagram of a system for dispensing ink on a writable medium, in accordance with one embodiment of the present invention. The system comprises an electronic brush 10 including an electronic-brush scanner 14 to scan for position indicators in a first portion of a dispensed image. The position of electronic brush 10 may be determined in cooperation with a controller 16 wired or wirelessly connected to electronic-brush scanner 14 and ink dispensers 20. An ink-dispense signal 18 is sent from controller 16 to ink dispensers 20 based on the determined electronic-brush position. Controller 16 may embed position indicators in a second portion of the image by modifying image data supplied to the system.

Exemplary electronic-brush scanner 14 scans for one or more position indicators in a first written portion of a dispensed image to determine position, location and rotation information of electronic brush 10. Controller 16 executing instructions stored in a memory 24 may determine positions of electronic brush 10 based on the scanned position indicators and the received position signals. Memory 24 such as internal memory, external memory, optical memory, magnetic memory, flash memory, a memory card, a memory stick, or a memory key also can be used to store image data that is to be written onto the writable medium. Controller 16 in conjunction with memory 24 is able to modify the image data by inserting position indicators in a second, unwritten portion of the image based on the determined position of electronic brush 10. Ink dispensers 20 are used to write image data with position indicators onto the writable medium.

In an exemplary electronic-brush system, electronic-brush position signals 44 are received from one or more position detectors 50 to determine an initial position of electronic brush 10. Electronic-brush position signals 44 are received from, for example, one or more wheel position detectors coupled to electronic-brush wheels, at least one trackball or optical mouse coupled to electronic brush 10, one or more ultrasonic transducers attached to electronic brush 10, an ultrasonic transducer 38 attached to the writable medium (see FIG. 1), a tilt sensor 52 coupled to electronic brush 10, a global positioning system unit 54 attached to electronic brush 10, or a combination thereof.

Initial portions of the image and subsequent portions of the image are dispensed onto the writable medium with ink dispensers 20. The initial and subsequent portions of the image may include position indicators written into or beside the image. Ink dispensers 20 are used to dispense ink 22 and write portions of the image with position indicators onto the writable medium. Among the various types of ink dispensers 20 used to dispense ink 22 are inkjet cartridges, solid-ink printheads, dry-ink printheads, dot matrix printheads, actuatable felt-tip pens, non-contact ink dispensers, ink ejection nozzles, glue dispensers, and liquid dispensers.

Figure 5:
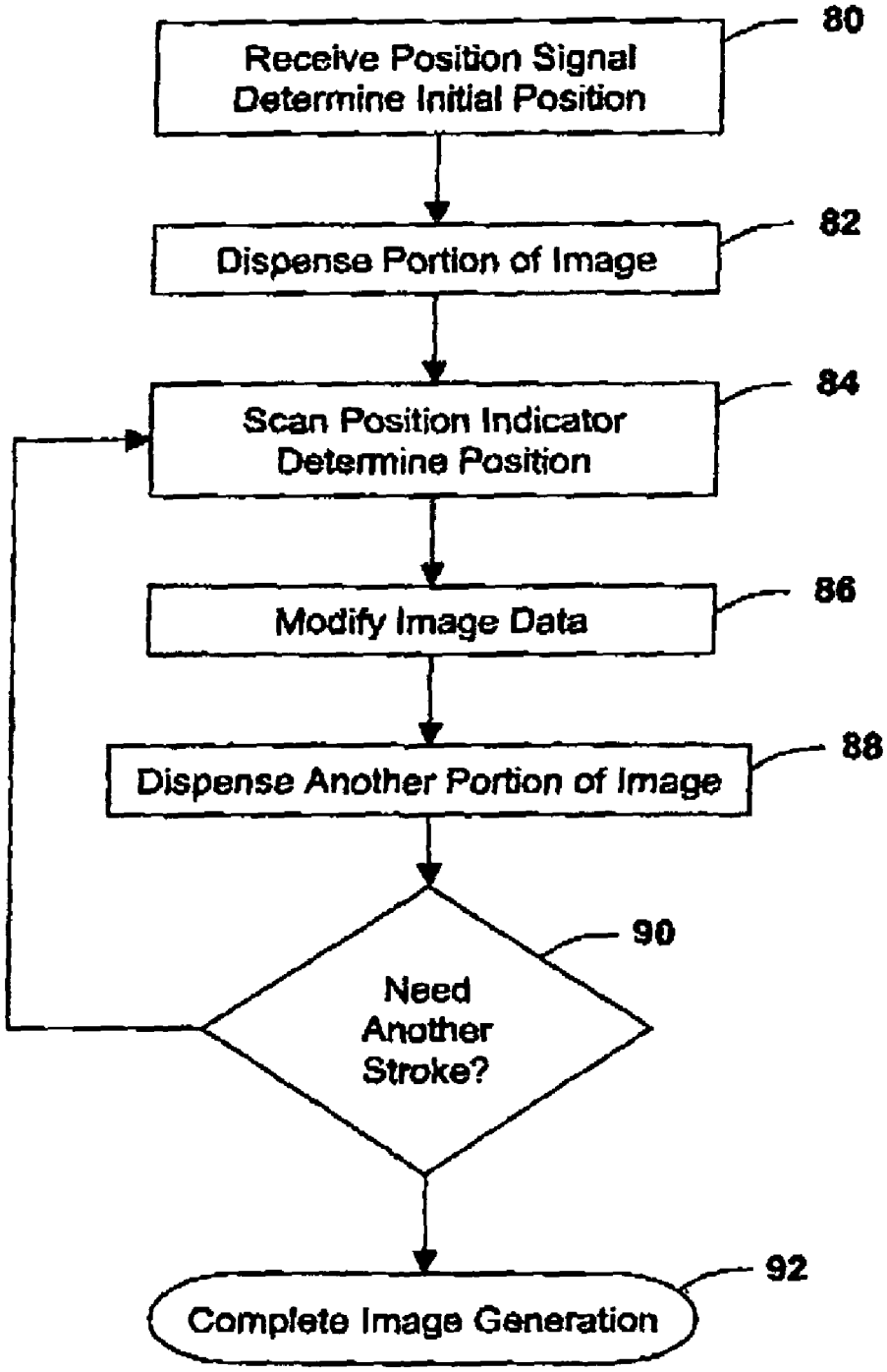
FIG. 5 is a flow chart of a method for dispensing ink on a writable medium in accordance with one embodiment of the current invention.

FIG. 5 shows a flow chart of a method for dispensing ink on a writable medium, in accordance with one embodiment of the present invention. The method includes steps to determine the position of an electronic brush and to dispense ink onto a writable medium accordingly. The method also includes various steps to write position indicators onto the writable medium and to read the written position indicators, which help determine the location and rotation of the electronic brush so that additional strokes of the electronic brush can complete unwritten portions of the image.

The electronic brush is positioned against the surface of a writable medium and an electronic-brush position signal is received, as seen at block 80. In some embodiments of the present invention, there are no registration codes in the dispensed ink when the electronic brush is scanned across the surface of the writable medium for the first time. Until position indicators can be written on the writable medium, input signals from one or more position detectors on the electronic brush provide electronic-brush position signals from which the location and rotation of the electronic brush are determined. In other embodiments, position indicators are prewritten onto the writable medium, eliminating the need for input from one or more position detectors to determine the position of the electronic brush.

Accurate writing of the first portion of the image with the first position indicators may be aided by the inclusion of, for example, a reference point on the writable medium such as a corner, a frame around the writable medium, a set of position indicators permanently disposed in at least a portion of the writable medium, a mechanical guide, or another suitable registration mechanism. From this initial written portion, position indicators may be added as the image is written.

Other mechanisms and devices may be used to establish the location and rotation of the electronic brush. In one example, a wheel position signal is received from one or more wheel position detectors coupled to wheels of the electronic brush. In another example, a trackball position signal is received from one or more trackballs attached to the electronic brush. In another example, an optical mouse position signal is received from one or more optical mice attached to the electronic brush. In another example, an ultrasonic signal is received from one or more ultrasonic transducers either attached to the electronic brush or to the writable medium. In another example, a tilt signal is received from a tilt sensor attached to the electronic brush. In yet another example, a global positioning system signal is received from a global positioning system unit attached to the electronic brush.

When the electronic-brush position signals are received, an initial position of the electronic brush is determined based on the received position signals.

A first portion of an image is dispensed onto the writable medium with at least one ink dispenser, as seen at block 82. One or more ink dispensers are coupled to the electronic brush to allow for printing on a wide, printable area while the electronic brush is stroked multiple times across the surface of the writable medium. The ink dispensers include inkjet cartridges, solid-ink printheads, dry-ink printheads, dot matrix printheads, actuatable felt-tip pens, non-contact ink dispensers, ink ejection nozzles, glue dispensers, liquid dispensers, or any other suitable ink dispensing mechanism. The first portion of the dispensed image may include one or more position indicators such as optical characters representing numbered coordinates, letters, surface coordinates, barcodes, UPC codes, coded coordinates, markers, grids, cross hairs, registration marks or other suitable surface-location identifiers. Position indicators may be written within the first portion of the dispensed image or written near an edge of the image portion so that a subsequent stroke of the electronic brush can read and fill, write over, or retain the position indicators.

As the electronic brush completes a stroke and is repositioned to begin a second stroke, position indicators in the first portion of the dispensed image on the writable medium are scanned, as seen at block 84. Based on the scanned position indicators, the position of the electronic brush may be determined.

The position of the electronic brush is determined, for example, by determining a writable-medium coordinate based on the scanned position indicator, and determining the position of the electronic brush based on the writable-medium coordinate. In another example, the position of the electronic brush may be deter mined by scanning a plurality of first position indicators in the first portion of the dispensed, and determining the location and rotation of the electronic brush based on the scanned position indicators. In another example, the position of the electronic brush may be determined by comparing the scanned position indicators to unmodified image data using pattern recognition techniques, and then determining the position of the electronic brush based on the comparison. Coded position indicators may be used, for example, in conjunction with a lookup table stored in memory to translate the coded position indicator information into location coordinates, and location coordinates into position indicator information. A lookup table is not necessary, for example, when coordinate data in binary form is written into the position indicators.

Electronic brush rotation can be determined, for example, from adjacent position indicators or from position indicators that are further apart yet within range of the electronic-brush scanner. Increased accuracy in rotation determination may be achieved with two spaced-apart electronic-brush scanners. Alternatively, electronic brush rotation may be determined from orientation information embedded with the position indicators. Electronic-brush rotations also may be determined from tilt signals received from a tilt sensor attached to the electronic brush. Alternatively, the electronic-brush rotation may be determined by scanning and reading a registration grid.

Image data is modified to embed a second position indicator in a second portion of the image based on the determined position of the electronic brush, as seen at block 86. The image data is modified by embedding the second position indicator in the second portion of the image through the manipulation of, for example, at least one image pixel in the second portion of the image. Manipulating at least one image pixel includes, for example, setting or clearing image pixels corresponding to the position indicators. Alternatively, manipulating at least one image pixel includes adjusting the image pixels so that a detectable position indicator can be written onto the writable medium, preferably with a hue, chromaticity, saturation or size that is minimal or undetectable by the human eye. Image data may be modified to embed coded position information within the position indicators during an initial operation on image data, or interactively as the image is being written. In either case, real-time image information can be provided prior to or while the image is being written with the electronic brush.

The second and additional portions of the image that have the second position indicators are dispensed onto the writable medium, as seen at block 88. The second and additional portions of the image are dispensed using the ink dispensers coupled to the electronic brush. The scanning and position determination steps are repeated while the electronic brush is moving across the surface of the writable medium to write additional portions of the image.

At this point in the ink-dispensing method, another stroke may be needed, as seen at block 90. For larger images, the electronic brush needs to be passed multiple times in overlapping strokes across the writable medium to construct a complete picture. After the electronic brush has been removed temporarily from the surface area or it has been moved to a new position to begin a new stroke, the writing of the image can continue once the electronic brush is in close proximity to the surface of the writable medium and the position of the electronic brush has been determined. Accurate determination of the electronic brush location and rotation reduces alignment artifacts caused by multiple strokes of the brush. When additional strokes are needed to continue or complete the image, the electronic brush is repositioned to overlap a previously written portion of the image and position indicators are scanned, as seen back at block 84.

When no additional strokes are needed, the image has been written and image generation is completed, as seen at block 92.

While the embodiments of the invention disclosed herein are presently considered to be preferred, various changes and modifications can be made without departing from the spirit and scope of the invention. The scope of the invention is indicated in the appended claims, and all changes that come within the meaning and range of equivalents are intended to be embraced therein.

The invention claimed is:

1. An electronic brush for dispensing ink onto a writable medium, the electronic brush comprising:

an electronic-brush housing;

at least one ink dispenser coupled to the electronic-brush housing;

an electronic-brush scanner coupled to the electronic-brush housing; and a controller in electrical communication with the ink dispenser and the electronic-brush scanner, wherein a position of the electronic brush is determined based on at least one position indicator in a first portion of a dispensed image that is scanned by the electronic-brush scanner and communicated to the controller, and wherein an ink-dispense signal is sent from the controller to the ink dispenser based on the determined electronic-brush position; and wherein the image data is modified to embed a second position indicator in a second portion of the image based on the determined position of the electronic brush.

2. The electronic brush of claim 1, wherein the writable medium is selected from the group consisting of a whiteboard, a wall, a poster, a billboard, a fabric, a notebook, a sheet of paper, a piece of cardboard, a non-paper material, and a writable surface.

3. The electronic brush of claim 1, wherein the ink dispenser is selected from the group consisting of an inkjet cartridge, a solid-ink printhead, a dry-ink printhead, a dot matrix printhead, an actuatable felt-tip pen, a non-contact ink dispenser, an ink ejection nozzle, a glue dispenser, and a liquid dispenser.

4. The electronic brush of claim 1, wherein the electronic-brush scanner includes one of an optical scanner and at least one imaging array.

5. The electronic brush of claim 1, wherein the controller is wired to or wirelessly connected to the ink dispenser and the electronic-brush scanner.

6. The electronic brush of claim 1, further comprising:

at least one position detector coupled to the electronic brush for determining an initial position of the electronic brush.

7. The electronic brush of claim 6, wherein the position detector is selected from the group consisting of a wheel position detector, a trackball, an optical mouse, an ultrasonic transducer attached to the electronic brush, an ultrasonic transducer attached to the writable medium, a tilt sensor, and a global positioning system unit.

8. A method of dispensing ink on a writable medium, the method comprising:

scanning a first position indicator in a first portion of a dispensed image on the writable medium;

determining a position of an electronic brush based on the scanned position indicator;

modifying image data to embed a second position indicator in a second portion of the image based on the determined position of the electronic brush; and dispensing the second portion of the image including the second position indicator onto the writable medium.

9. The method of claim 8, wherein determining the position of the electronic brush includes:

comparing the scanned position indicator to unmodified image data; and determining the position of the electronic brush based on the comparison.

10. The method of claim 8, wherein determining the position of the electronic brush includes:

determining a writable-medium coordinate based on the scanned position indicator; and determining the position of the electronic brush based on the writable-medium coordinate.

11. The method of claim 8, wherein determining the position of the electronic brush includes:

scanning a plurality of first position indicators in the first portion of the dispensed image; and determining the location and rotation of the electronic brush based on the scanned position indicators.

12. The method of claim 8, wherein modifying the image data to embed the second position indicator in the second portion of the image includes:

manipulating at least one image pixel in the second portion of the image.

13. The method of claim 12, wherein manipulating at least one image pixel includes:

setting or clearing the at least one image pixel.

14. The method of claim 12, wherein manipulating at least one image pixel includes:

adjusting the at least one image pixel.

15. The method of claim 8, wherein the second portion of the image is dispensed using at least one ink dispenser coupled to the electronic brush.

16. The method of claim 15, wherein the ink dispenser is selected from the group consisting of an inkjet cartridge, a solid-ink printhead, a dry-ink printhead, a dot matrix printhead, an actuatable felt-tip pen, a non-contact ink dispenser, an ink ejection nozzle, a glue dispenser, and a liquid dispenser.

17. The method of claim 8, further comprising:

receiving an electronic-brush position signal; and determining an initial position of the electronic brush based on the received position signal.

18. The method of claim 17, wherein receiving the position signal is selected from the group consisting of: receiving a wheel position signal from one or more wheels coupled to the electronic brush; receiving a trackball position signal from one or more trackballs attached to the electronic brush; receiving an optical mouse position signal from one or more optical mice attached to the electronic brush; receiving an ultrasonic signal from one or more ultrasonic transducers attached to the electronic brush; receiving an ultrasonic signal from one or more ultrasonic transducers attached to the writable medium; receiving a tilt signal from a tilt sensor attached to the electronic brush; and receiving a global positioning system signal from a global positioning system unit attached to the electronic brush.

19. The method of claim 8, further comprising:

dispensing the first portion of the image onto the first portion of the writable medium, wherein the first portion of the image includes the first position indicator.

20. A system for dispensing ink on a writable medium, the system comprising:

means for scanning a first position indicator in a first portion of a dispensed image on the writable medium;

means for determining a position of an electronic brush based on the scanned position indicator;

means for modifying image data to embed a second position indicator in a second portion of the image based on the determined position of the electronic brush; and means for dispensing the second portion of the image including the second position indicator onto the writable medium.

21. The system of claim 20, further comprising:

means for receiving an electronic-brush position signal; and means for determining an initial position of the electronic brush based on the received position signal.

22. The system of claim 20, further comprising:

means for dispensing the first portion of the image onto the first portion of the writable medium, wherein the first portion of the image includes the first position indicator.

* * * * *